US007908691B2

(12) United States Patent
Small

(10) Patent No.: US 7,908,691 B2
(45) Date of Patent: Mar. 22, 2011

(54) MEDICAL SUPPORT PILLOW

(76) Inventor: Thomas J. Small, Franklin, IN (US)

( * ) Notice: Subject to any disclaimer, the term of this patent is extended or adjusted under 35 U.S.C. 154(b) by 0 days.

(21) Appl. No.: 11/636,946

(22) Filed: Dec. 12, 2006

(65) Prior Publication Data

US 2008/0134437 A1 Jun. 12, 2008

(51) Int. Cl.
*A47C 20/00* (2006.01)

(52) U.S. Cl. ..... 5/632; 5/630; 5/636

(58) Field of Classification Search ..... 5/632, 630, 5/636, 622, 652
See application file for complete search history.

(56) References Cited

U.S. PATENT DOCUMENTS

| | | | | |
|---|---|---|---|---|
| 3,648,308 | A | 3/1972 | Greenawalt | |
| 3,829,917 | A | 8/1974 | De Laittre et al. | |
| 4,320,543 | A | 3/1982 | Dixon | |
| 4,424,599 | A | 1/1984 | Hannouche | |
| 4,494,261 | A | 1/1985 | Morrow | |
| 4,918,774 | A | 4/1990 | Popitz | |
| 5,479,667 | A * | 1/1996 | Nelson et al. | 5/636 |
| 5,581,831 | A | 12/1996 | Xiang | |
| 6,446,288 | B1 | 9/2002 | Pi | |
| 6,751,818 | B2 | 6/2004 | Troop | |

* cited by examiner

*Primary Examiner* — Jonathan J Liu
(74) *Attorney, Agent, or Firm* — Taft Stettinius & Hollister LLP

(57) ABSTRACT

The present invention provides a medical support pillow and method for supporting a patient in the lateral position while maintaining an open airway. The lateral airway support pillow includes a chest support, a shoulder recess, a head support and a posterior bolster. The orientation of these components support the patient in the lateral position, with the spine and airway in a straight position, thus eliminating possible airway obstruction. One embodiment of the invention contains a head support with a posterior recess and a neck support which provides for straightening of the neck and airway and aligning the oral, pharyngeal, and laryngeal axes of the airway. Other embodiments position and elevate the patient in such a manner to treat or prevent soft tissue pressure injury, gastroesophageal reflux, congestive heart failure, or sleep apnea.

10 Claims, 10 Drawing Sheets

MEDICAL SUPPORT PILLOW

RELATED APPLICATIONS

The present application is related to U.S. Pat. No. 3,648, 308, issued Mar. 14, 1972, for ELEVATED TRACTION PILLOW, by Greenawalt, included by reference herein.

The present application is related to U.S. Pat. No. 3,829, 917, issued Aug. 20, 1974, for THERAPEUTIC PILLOW, by De Laittre, included by reference herein.

The present application is related to U.S. Pat. No. 4,320, 543, issued Mar. 23, 1982, for MEDICAL PILLOW, by Dixon, included by reference herein.

The present application is related to U.S. Pat. No. 4,424, 599, issued Jan. 10, 1984, for CERVICAL PILLOW, by Hannouche, included by reference herein.

The present application is related to U.S. Pat. No. 4,494, 261, issued Jan. 22, 1985, for HEAD AND NECK CUSHION, by Morrow, included by reference herein.

The present application is related to U.S. Pat. No. 4,918, 774, issued Apr. 24, 1990, for MEDICAL SUPPORT PILLOW, by Popitz, included by reference herein.

The present application is related to U.S. Pat. No. 5,581, 831, issued Dec. 10, 1996, for ERGONOMIC PILLOW, by Xiang, included by reference herein.

The present application is related to U.S. Pat. No. 6,446, 288 B1, issued Sep. 10, 2002, for MEDICAL SUPPORT PILLOW FOR FACILITATING ENDOTRACHEAL INTUBATION, by Pi, included by reference herein.

The present application is related to U.S. Pat. No. 6,751, 818 B2, issued Jan. 22, 2004, for AIRWAY MANAGEMENT APPARATUS AND METHOD, by Troop, included by reference herein.

FIELD OF THE INVENTION

The present invention relates to a supportive pillow for medical and surgical procedures and more particularly to a supportive pillow which allows the patient to maintain an open and adequate airway while in the lateral position.

BACKGROUND OF THE INVENTION

Medical practice and patient care has experienced significant changes over the recent past including huge increases in the number of outpatient medical, surgical, and radiologic procedures. The use of flexible fiberoptic endoscopy for diagnostic and therapeutic procedures has grown worldwide. Conscious sedation and short-acting anesthetic agents have enabled a much greater variety of procedures to be accomplished on an outpatient basis. Because of the brief duration of many of these procedures and the use of conscious sedation, the placement of a mechanical airway is omitted. This may result in manipulation or support of the patient by the nursing or anesthesia staff to maintain an adequate airway during and after a procedure until the patient is fully recovered. Many of these procedures are performed in the lateral position, further complicating patient position and airway management.

The state of medical practice dictates the care of more elderly and of more obese patients, further complicating the positioning and airway management of these patients during a procedure. The patient support addressed in the Troop patent (U.S. Pat. No. 6,751,818) discloses an airway management apparatus which supports the chest, neck, and head of a patient, allowing the abdominal mass to be displaced, thus improving airway position and ventilation. This cushion does not accommodate the lateral position which is widely used.

The Xiang patent (U.S. Pat. No. 5,581,831) addresses the support of a patient in the lateral position for comfort, but the chest is not supported independently of the shoulder, resulting in lateral angulation of the cervical spine and the airway. The shoulder is allowed to impinge on the neck, and the head is not supported in a position to maintain a secure airway. This device also does not support the patient from shifting laterally or easily rolling off of the cushion.

There has been a vast increase in the number of patients in rehabilitation hospitals and extended care facilities requiring the nursing staff to position and move them while they are recumbent. Supporting and cushioning patients to avoid soft tissue pressure injury over a bony prominence is a major priority of patient care. The morbidity and mortality from complications of pressure sores is great and consumes massive financial and personnel resources. Many patients require apnea monitoring during long term care and airway maintenance requires considerable time and attention from nursing and respiratory therapy staff. Techniques of padding and bolstering patients with common bed pillows in the lateral position yield inadequate results and require multiple staff members to reposition patients every two hours.

The treatment of gastroesophageal reflux and congestive heart failure, as well as other conditions, require elevation of the head of the patient's bed. The classic recommendation is to place blocks or bricks under the legs of the bed at the patient's head. Several drawbacks are apparent in this technique. The patient usually slides out the foot of the bed, and a bed partner is made uncomfortable by the position of the bed. The use of blocks or bricks is not possible with a water mattress. The expense of an adjustable hospital bed is prohibitive for most patients. The technique does not lend itself to maintaining good airway support in the head-elevated supine position or the lateral position. Many of these patients are obese and have sleep apnea and the elevated position does not support the head and neck, thus complicating the already compromised airway.

Because of the increased use of the lateral position in diagnostic and therapeutic procedures requiring sedation or anesthesia, without the use of a mechanical airway, attention is drawn to adequate support and positioning of the patient during and after these procedures. Likewise, the use of the lateral position in long term care requires attention to proper positioning, padding, and airway support. Therefore, a medical support pillow that meets these multiple needs is the object of the present invention.

It is therefore an object of the invention to support and stabilize the patient in the lateral position while maintaining an open airway.

It is another object of the invention to enhance spontaneous respiration by aligning the airway in the anterior-posterior, and lateral directions.

It is another object of the invention to assist the anesthesiologist in placing a mechanical airway prior to a procedure requiring the lateral position.

It is another object of the invention to support the patient with limited mobility in such a way to maintain an adequate airway and protect against soft tissue pressure injury.

It is another object of the invention to provide support and elevation of the head, neck and thorax of the patient in the supine, right, or left lateral positions.

SUMMARY OF THE INVENTION

In accordance with the present invention, there is provided a medical support pillow and method for supporting a patient in the lateral position while maintaining an open airway. The lateral airway support pillow includes a chest support, shoulder recess, head support, and posterior bolster. For purposes of the discussion, the following definitions are offered:

ANTERIOR—toward the direction the patient is facing while in the lateral position.

POSTERIOR—opposite the direction the patient is facing while in the lateral position.

CEPHALAD—toward the head of a patient on the lateral airway support pillow.

CAUDAL—toward the feet of a patient on the lateral airway support pillow.

The lateral airway support pillow supports the chest of the patient in the lateral position by elevating it above the level of the mattress of the patient support. This allows the shoulder recess to receive the shoulder and upper arm in a natural position without the shoulder compressing or impinging upon the head, the chest wall, or the neck. The anterior portion of the head support receives the head while maintaining a straight orientation of the thoracic and cervical spines in the lateral direction. The elevation of the chest and the head at an incline allows the abdominal contents to fall away from the diaphragm, thus easing spontaneous ventilation. In most patients, this will insure an open airway. In some patients, however, relaxation of the soft tissues of the pharynx will compromise the airway during and after sedation or anesthesia. These patients will benefit from the placing of the head and neck over a neck support and into a posterior recess of the head support. This aligns the oral, pharyngeal, and laryngeal axes for an open airway and unimpeded spontaneous respiration. The superior shoulder of the patient is moved posteriorly against the posterior bolster, allowing the head to be positioned in the posterior recess of the head support.

Another aspect of the of the present invention allows for the patient to be positioned supine on the lateral airway support pillow while induced under general anesthetic. The head could be placed in the posterior recess of the head support for aligning the oral, pharyngeal, and laryngeal axes of the airway, and then endotracheal intubation or the placement of a laryngeal mask could be easily achieved. The patient could be rolled to the lateral position for the surgical procedure. This technique would prove useful for thoracic surgery or hip surgery in the lateral position. The patient would supported securely and uniformly with the lateral airway support pillow without fear of pressure injury to the soft tissues. Post operative recovery, including airway management, would be facilitated by use of the lateral airway support pillow.

Another aspect of the invention allows for the support of a long-term care patient with limited mobility, in the lateral position, to prevent pressure injury to the soft tissue of the presacral area and other areas. A reversible version of the lateral airway support pillow without the posterior recess in the head support positions the patient in either the left or right lateral position while awake or asleep. This device is called the reversible lateral support pillow.

Another aspect of the invention is useful for patients requiring elevation of the head and thorax for the treatment of conditions such as gastroesophageal reflux, congestive heart failure and sleep apnea. This device has a middle portion for supporting the patient in the supine position with the thorax, neck, and head elevated and supported. Should the patient desire to recline in either the right or left lateral position, accommodation with bilateral chest supports, shoulder recesses, and head supports is presented. The head, neck, and chest are supported and elevated in the lateral positions as they are in the supine position. This version of the invention would also be useful in the long-term care setting. It is called the bilateral support pillow.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENTS

Figure 1:
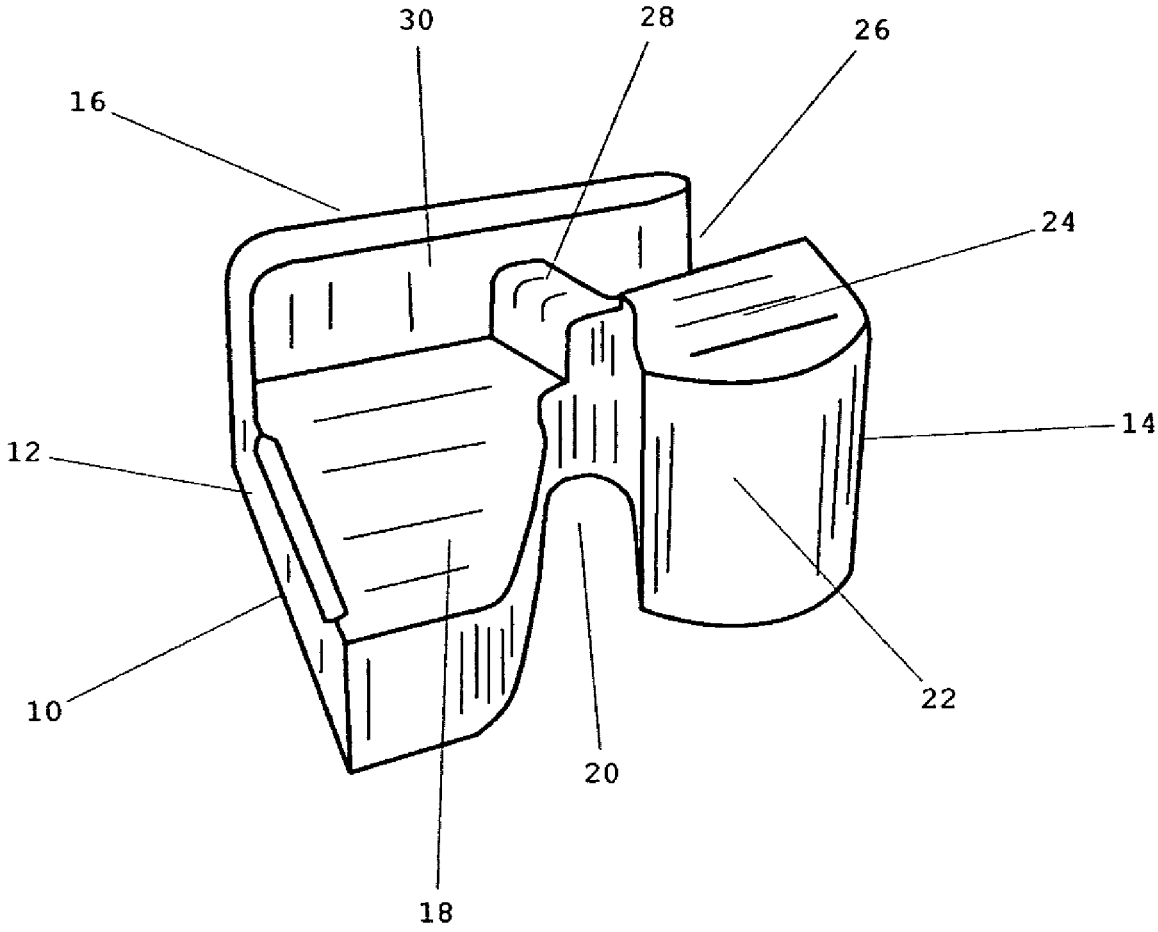
FIG. 1 is a perspective view of a lateral airway support pillow, viewed from the anterior and caudal aspects of the invention.

Preferred embodiments of the invention are described below with reference to various examples of how the invention can best be constructed and be used. Like reference numerals are used throughout the description and the drawings to indicate corresponding parts.

Referring now to FIG. 1., the lateral airway support pillow is fashioned to support a patient in the lateral position. It fully supports the chest, neck, and head of the patient in such a position so as to preserve an adequate airway and to stabilize the patient in such a position to satisfactorily perform the required procedure. It is made to be used on a patient support such as a bed, transfer cart, or operating table. It has a base 10 having a substantially planar surface to allow positioning on the patient support. It has a posterior surface 16 and two ends, one designated as the caudal end 12 and an opposing margin as the cephalad end 14.

Major components comprise a chest support 18 which is of size and thickness to lift the thorax of the patient a distance from the patient support, thus allowing the dependent shoulder and the upper arm of the patient to reside in the shoulder recess 20. The shoulder recess 20, which is arcuately shaped, is of adequate size to allow the shoulder and upper arm to assume a natural position, and not be compressed by the weight of the patient.

The head support 22 is substantially thicker than the chest support 18 and thus aligns the cervical spine with the thoracic spine. As the hips of the patient lie on the patient support, the cervical and thoracic spines are aligned with the lumbar spine. The head support 22 contains a posterior recess support surface and an anterior planar support surface, with the posterior recess support surface being substantially parallel to and located adjacent to an in a lower position than the anterior planar support surface. The posterior recess is coupled to the head support 22 and has a first substantially vertical surface disposed between the anterior planar support surface and the posterior recess support surface. The posterior recess, in turn, is disposed between the first substantially vertical surface and a second substantially vertical surface of the posterior bolster 30, such that the first and second substantially vertical surfaces are substantially parallel to one another and separated by the posterior recess support surface. The anterior planar surface receives the head of the patient. The dependent side of a patient's head and face contact the anterior planar surface of the head support 24. The posterior recess of the head support 26 receives the posterior portion of the patient's head when the patient is rolled posteriorly onto the posterior bolster 30. This allows the neck of the patient to extend over and be supported by the neck support 28. The neck support 28 includes a substantially planar top surface and first and second ends, the first end terminating into the shoulder recess and the second end terminating into the second substantially vertical surface of the posterior bolster 30. In addition, the second substantially vertical surface extends vertically upward form the top surface of the neck support 28 and is configured to support the head of the patient when it is in the posterior recess and to support the back of the patient when the patient is rotated posteriorly. The airway is straightened in the anterior-posterior plane by this action and the tracheal, laryngeal, and oral axes of the upper airway are aligned. The lateral airway support pillow maintains this position once the patient's head is properly introduced into the poster recess of the head support 26. Further traction or manipulation is not necessary to maintain a secure airway. The size and depth of the posterior recess of the head support 26 is sufficient to receive the head and straighten the airway.

Figure 2:
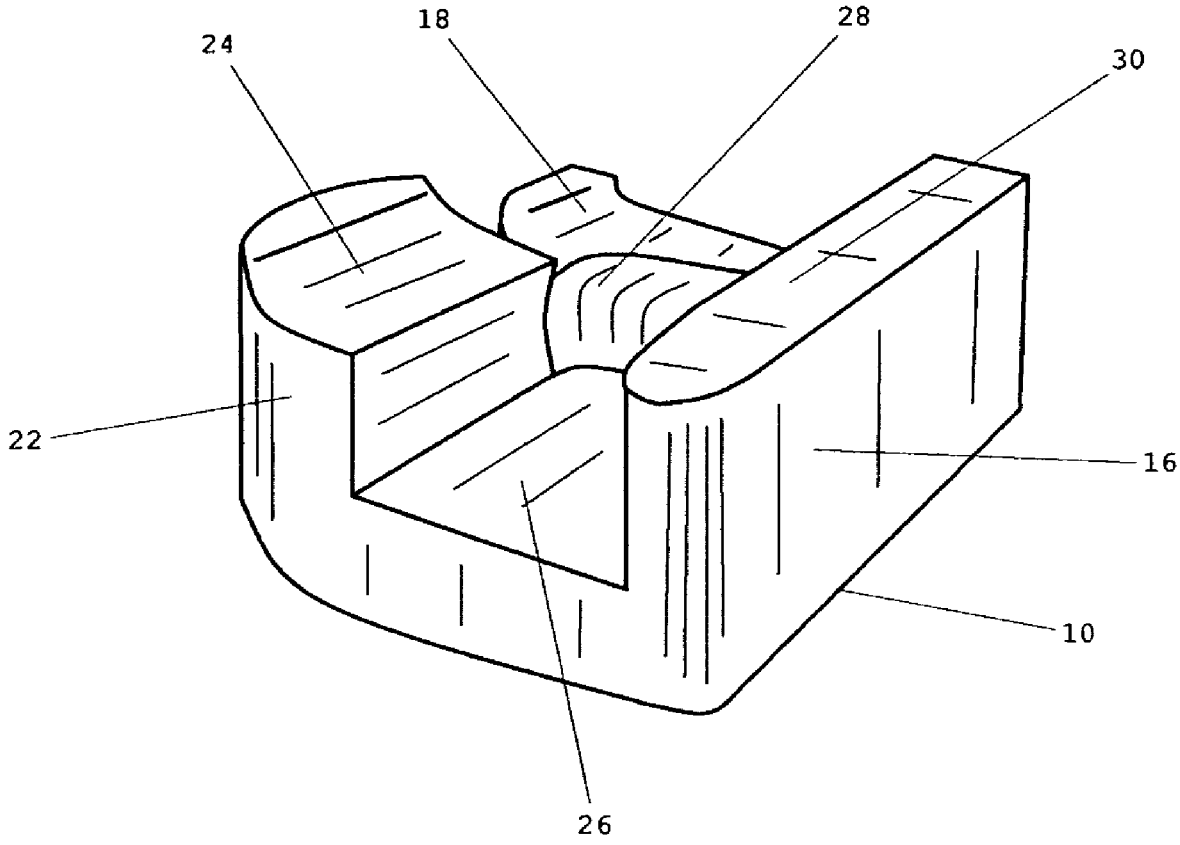
FIG. 2 is a perspective view of a lateral airway support pillow viewed from the cephalad end of the invention.

Referring to FIG. 2., the lateral airway support pillow is viewed from the cephalad end 14 to illustrate the detail of the head support 22. The size, depth, and position of the posterior recess of the head support 26 and its relationship to the anterior planar surface of the head support 24 are demonstrated. The posterior bolster 30 extends the full length of the lateral airway support pillow from the caudal end 12 to the cephalad end 14. The posterior bolster 30 serves to support the head of the patient when it is in the posterior recess of the head support 26, and to support the back of the patient when the patient is rotated posteriorly.

Figure 3:
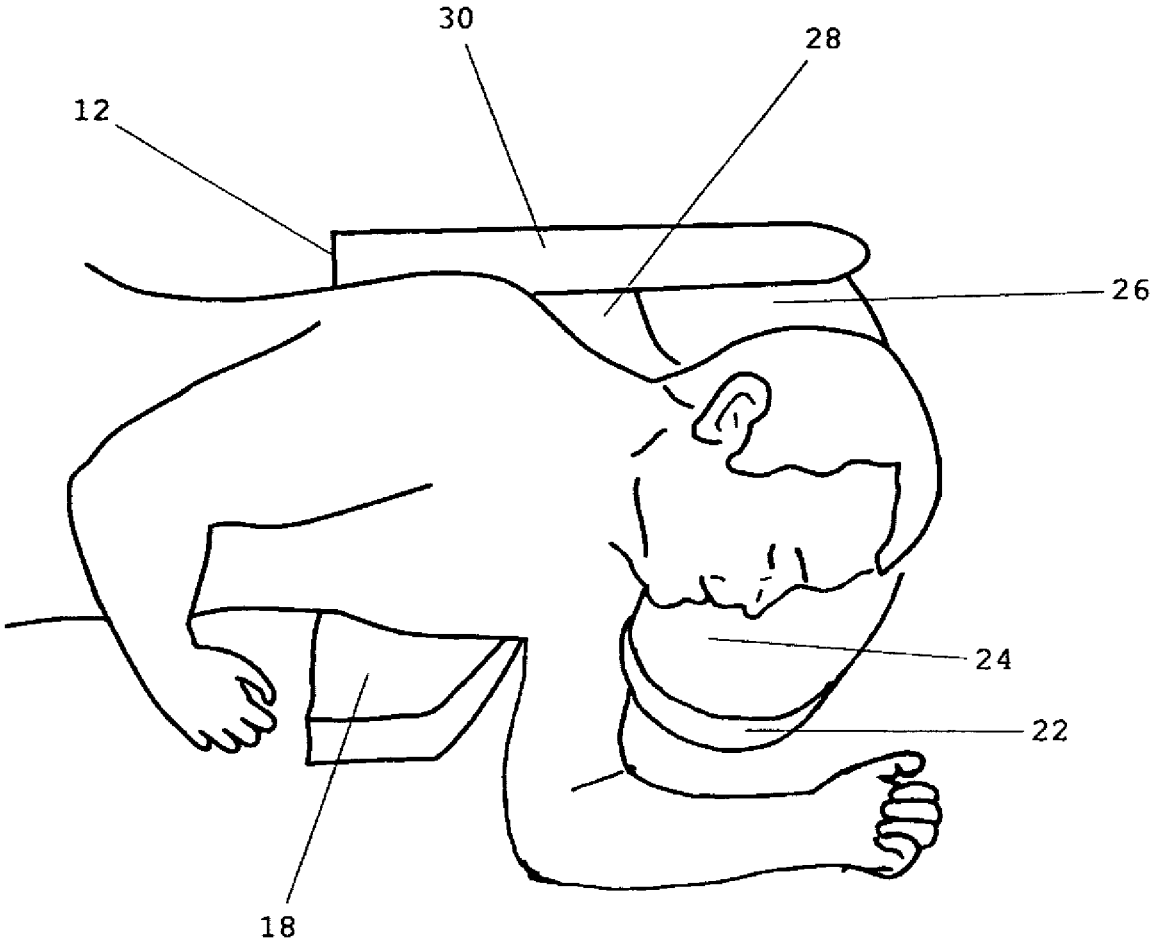
FIG. 3 is a top plan view of a lateral airway support pillow, in use, with the head of the patient positioned on the anterior planar surface of the head support.

Referring to FIG. 3., the patient is depicted from overhead, lying in the lateral position on the airway support pillow with the head of the patient on the anterior planar surface of the head support 24. The chest support 18 is shown positioned under the patient's chest to allow the dependent shoulder and upper arm to occupy the shoulder recess 20. The posterior recess of the head support 26 is seen posterior to the patient's head.

Figure 4:
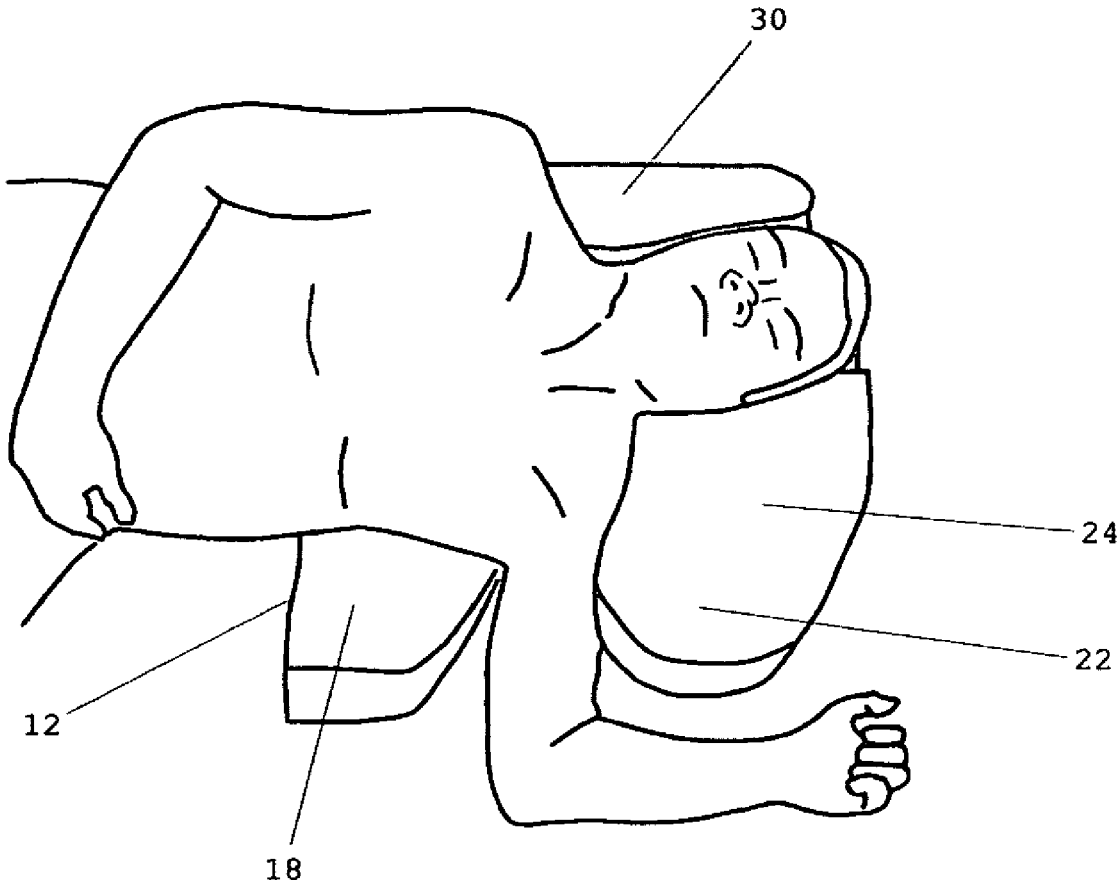
FIG. 4 is a top plan view of a lateral airway support pillow, in use, with the head of the patient positioned in the posterior recess of the head support.

Referring to FIG. 4., the superior shoulder of the patient is rotated posteriorly to rest on the posterior bolster 30, allowing the head to be introduced into the posterior recess of the head support 26, the neck to be extended, and the airway to be straightened. The neck is extended over and resting on the neck support 28. The back of the patient is reclining on, and fully supported by the posterior bolster 30.

Figure 5:
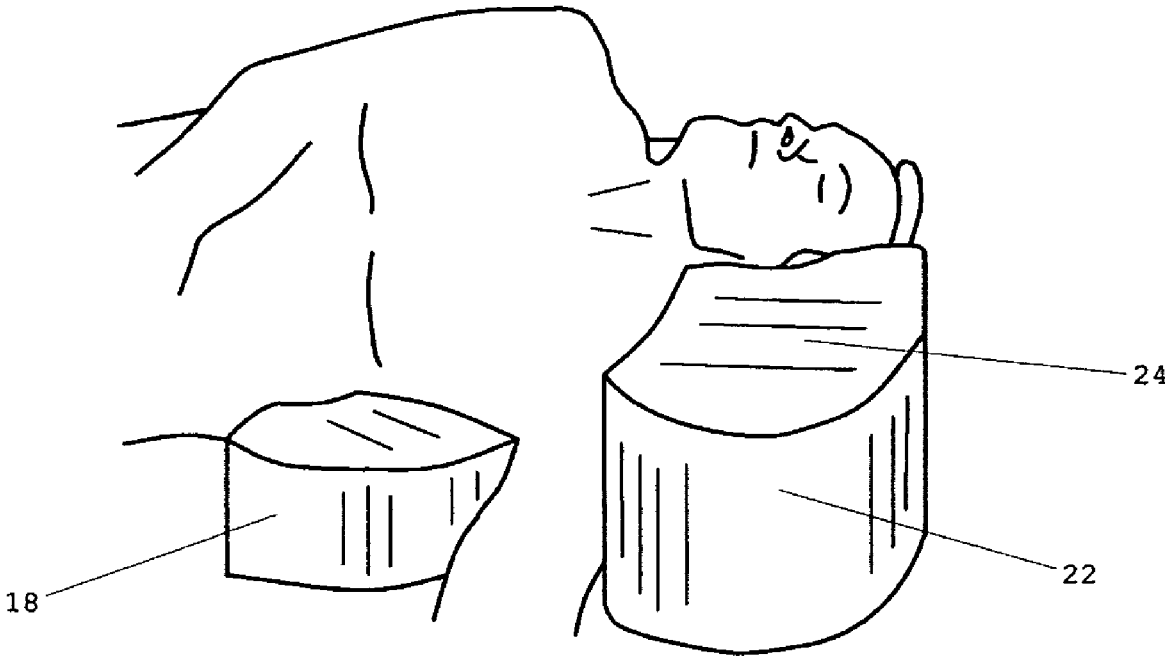
FIG. 5 is a perspective view of a patient on the lateral airway support pillow with the head in the posterior recess of the head support, demonstrating the extended neck and an open airway.

Referring to FIG. 5., the patient is rotated posteriorly and fully reclined in the lateral airway support pillow. This view demonstrates the positions of the chest and head being fully supported by the chest support 18 and the head support 22. The positions of the dependent shoulder and the upper arm are well demonstrated in this view. The head of the patient is in the posterior recess of the head support 26 and the straight orientation of the neck and airway is apparent.

Figure 6:
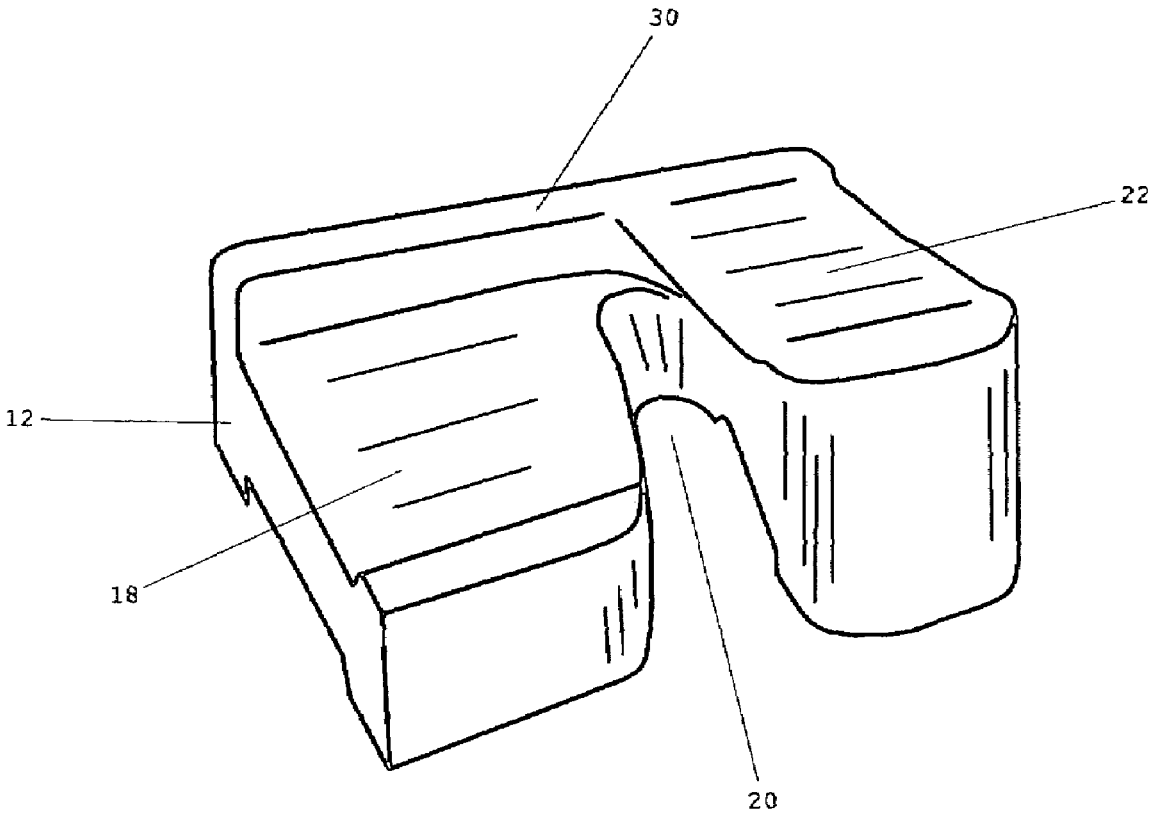
FIG. 6 is a left perspective view of an alternative embodiment of the invention, termed the reversible lateral support pillow.

Referring to FIG. 6., an alternative embodiment of the lateral airway support pillow is seen in the form of a reversible lateral support pillow. This perspective view from the caudal end 12 and anterior surface illustrates the detail of the chest support 18 and the caudal end 12 of end of the posterior bolster 30. The position of the posterior bolster 30 and the thicker anterior edge of the chest support 18, with the thinner mid-portion of the chest support 18, provides a cradle for the lateral surface of the chest of the patient. Security from rolling off of the reversible lateral support pillow is afforded. The shoulder recess 20 is seen to occupy the space between the chest support 18 and the head support 22. This accommodates the dependent shoulder and the upper arm of the patient. The head support 22 is seen to be in a similar configuration as the chest support 18, with the posterior bolster 30 and the thicker portion at the anterior edge of the head support 22 providing a secure cradle for the head. The large size of the head support 22 accommodates a variety of positions for the head when the patient is in the straight lateral position or the posterolateral position.

Figure 7:
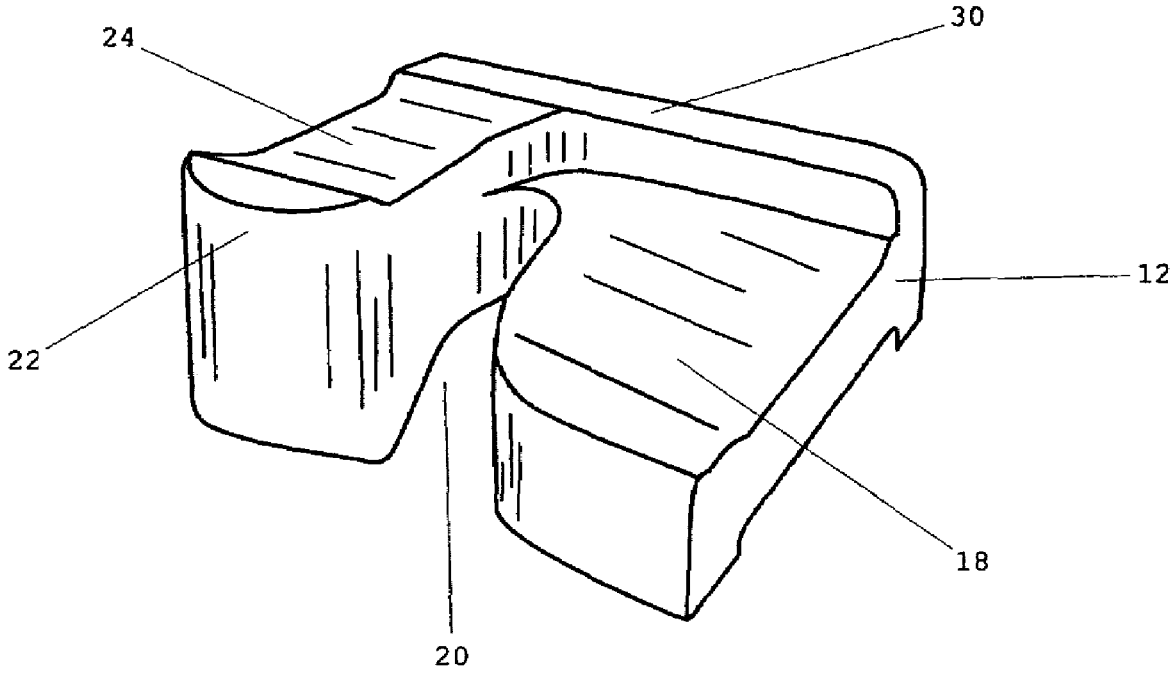
FIG. 7 is a right perspective view of a reversible lateral support pillow, reversed to accommodate a patient in the right lateral position.

Referring to FIG. 7., the reversible lateral support pillow is lying on the reverse side, thus accommodating a patient in the right lateral position. This view demonstrates that the reverse side is a mirror image to that depicted in FIG. 6.

Figure 8:
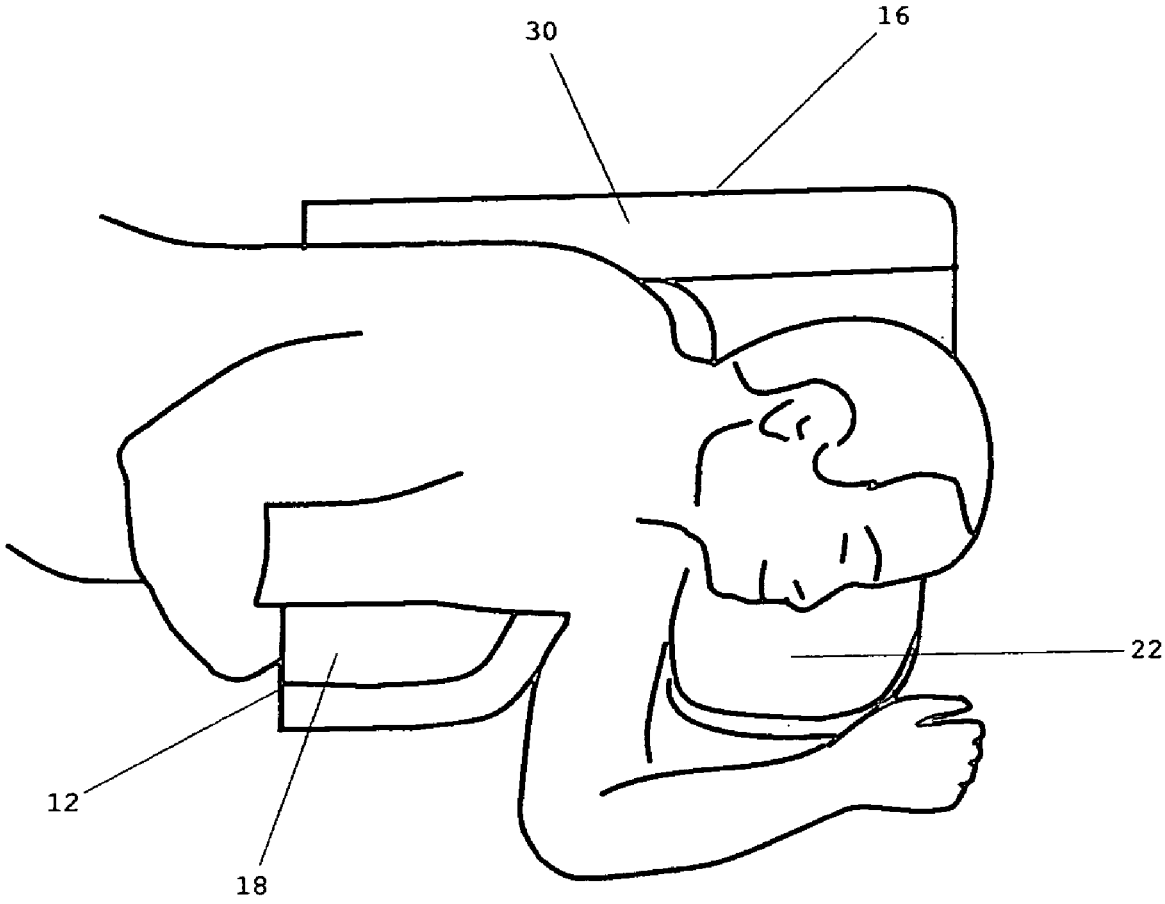
FIG. 8 is a top plan view of a reversible support pillow in use, with the patient supported in the straight left lateral position.

Referring to FIG. 8., the patient is in the straight lateral position on the reversible lateral support pillow. The patient's dependent shoulder and upper arm are placed in the shoulder recess 20. The head support 22 is noted to provide adequate space for a variety of positions. The posterior bolster 30 allows the patient to be in a posterolateral position while keeping the sacrum from contacting the patient support and therefore preventing pressure induced soft tissue injury.

Figure 9:
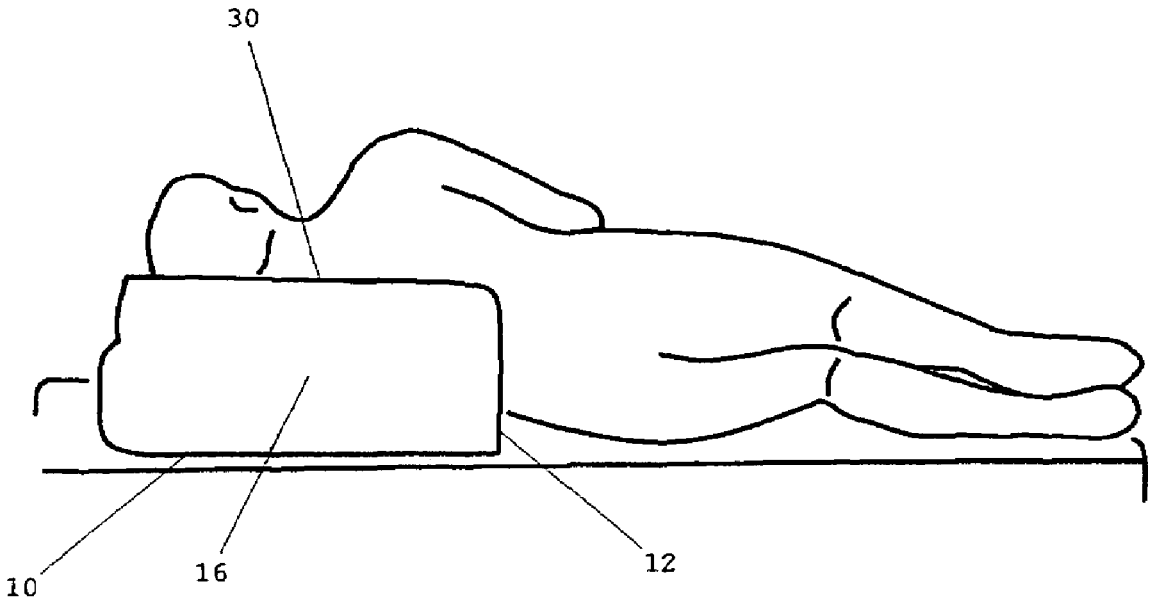
FIG. 9 is a rear view of a patient lying on the reversible lateral support pillow or the lateral airway support pillow.

Referring to FIG. 9., the patient is shown in the lateral position reclined on either the lateral airway support pillow or the reversible lateral support pillow and demonstrating the straight-line orientation of the cervical, thoracic, and lumbar portions of the spinal column. This orientation provides support and comfort for the patient and assists in the maintenance of the open airway. The invention also supports the patient without pressure from the patient support on the sacrum.

Figure 10:
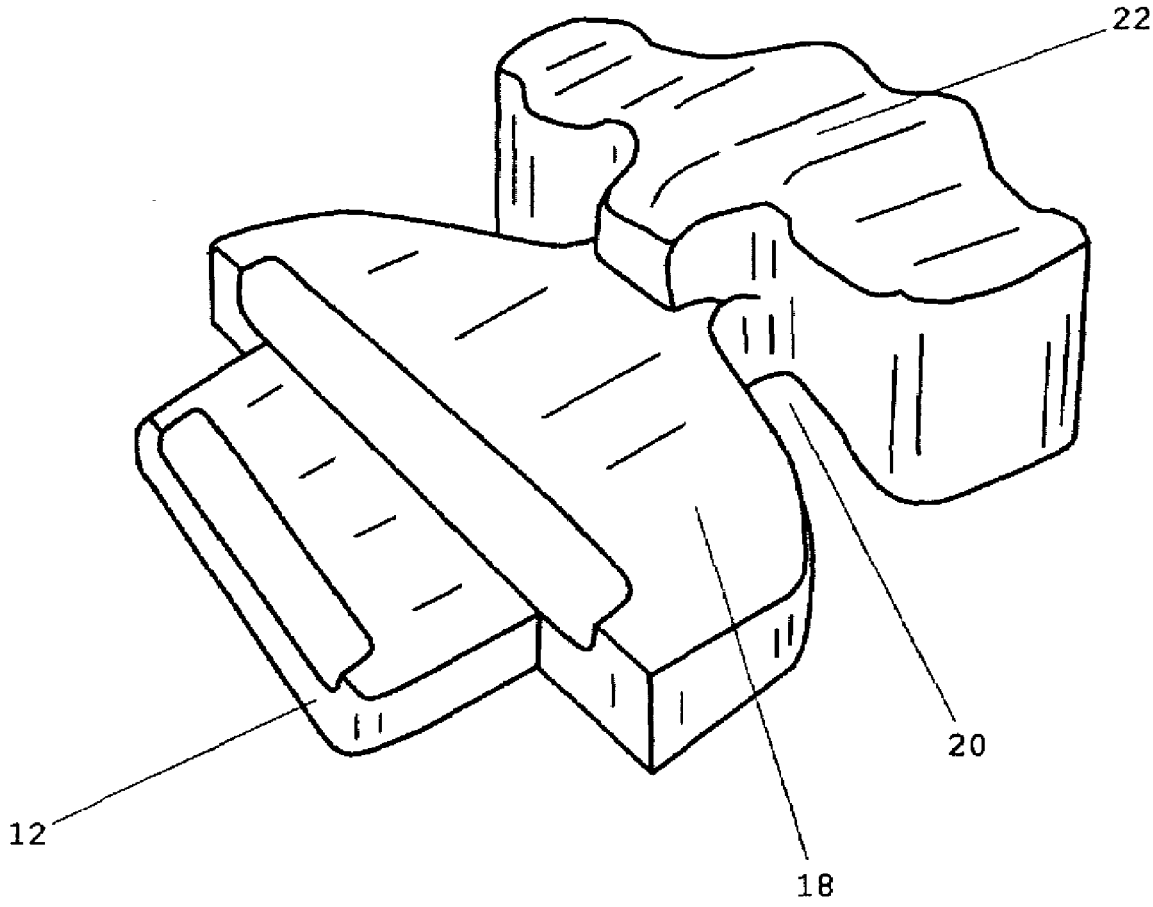
FIG. 10 is a perspective view of an additional embodiment of the lateral support pillow termed the elevated bilateral support pillow.

Referring to FIG. 10., an alternative embodiment is depicted for use for a patient wishing to elevate the head and chest above the level of the patient support, and yet still be able to lie in the supine position or in the left or right lateral positions. This invention would be useful in the management of gastroesophageal reflux, congestive heart failure, or sleep apnea. The head, neck, and thorax remain elevated in the lateral position as illustrated in FIG. 9. This embodiment contains a chest support 18, a left shoulder recess 20, a right shoulder recess 20, and a head support 22. The head support 22 is fashioned to cradle the head of the patient in the center of the head support 22 when the patient is in the supine position, or on either the left lateral planar surface or the right lateral planar surface of the head support 22, depending on the position of the patient.

The alternative embodiment described as the reversible lateral support pillow demonstrates that all embodiments of this invention could be constructed to be reversible by reproducing a mirror image of the obverse side on the reverse side. Some applications such as flexible fiberoptic endoscopy are most commonly performed in the left lateral position and a pillow made without the reversible feature would perform satisfactorily. Alternatively, applications such as hip surgery or chest surgery would utilize a reusable, reversible lateral airway support pillow. A reversible lateral support pillow would found useful in the long-term care unit to be able to alternate lateral positions while supporting the patient and helping eliminate soft tissue pressure injury.

Materials for the construction of these units could include urethane foam material which is formed to a specific shape in a mold or is constructed of smaller pieces of foam fastened to each other with adhesive. Different densities of foam may be employed to render a pillow of a desirable shape to function as described herein.

Other options include constructing a pillow with one or more inflatable chambers. This would allow for adjustment of size and rigidity of each chamber, thus allowing different support characteristics to patients of varying sizes and weights. The individual chambers could be inflated by a recycling, variable pressure pump, thus stimulating the circulation to the soft tissue and preventing points of prolonged high pressure.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A medical support pillow for supporting a patient on a patient support surface in the lateral position while maintaining an open and adequate airway, comprising:

a chest support for providing elevation and support of the chest of the patient above the level of the patient support surface;

an arcuately shaped recess for the accommodation of a dependent shoulder of the patient while lying in the lateral position on the pillow;

a head support for supporting the head of the patient when the patient is in the lateral position, the head support having a substantially planar anterior support surface and being configured to support the head of the patient in such a manner that the spine and the airway are allowed to be in a straight position;

a posterior recess including a substantially planar posterior recess support surface for accommodating the head of the patient, the posterior recess being coupled to the head support and having a first substantially vertical surface disposed between the anterior support surface and the posterior recess support surface;

a neck support for supporting the neck of the patient when the neck is extended thereover, the neck support being coupled to the head support; and a posterior bolster for supporting the patient when the patient's superior shoulder is rotated posteriorly against the bolster, the posterior bolster extending continuously along the entire length of the pillow and being coupled to the head support and coupled to said chest support, wherein the posterior recess is disposed between the first substantially vertical surface and a second substantially vertical surface of the posterior bolster, wherein the first and second substantially vertical surfaces are substantially parallel to one another and separated by the posterior recess support surface, the posterior recess support surface being substantially parallel to and located adjacent to and in a lower position than the anterior support surface, wherein the neck support includes a substantially planar top surface and first and second ends, the first end terminating into the arcuately shaped shoulder recess and the second end terminating into the second substantially vertical surface of the posterior bolster, the second substantially vertical surface extending vertically upward from the top surface of the neck support and being configured to support the head of the patient when it is in the posterior recess and to support the back of the patient when the patient is rotated posteriorly.

2. The medical support pillow in accordance with claim 1, wherein the chest support comprises a semi-compressible chest support.

3. The medical support pillow in accordance with claim 1, wherein the head support comprises a semi-compressible head support.

4. The medical support pillow in accordance with claim 1, wherein the neck support comprises a semi-compressible neck support.

5. The medical support pillow in accordance with claim 1, wherein the posterior bolster comprises a semi-compressible posterior bolster.

6. A medical support pillow for supporting a patient on a patient support surface in the lateral position while maintaining an open and adequate airway, comprising:

a semi-compressible chest support, for providing elevation and support of the chest of the patient above the level of the patient support surface;

a semi-compressible head support, for supporting the head of the patient, the semi-compressible head support including a lateral support having a substantially planar anterior support surface, for supporting the head of the patient when the patient is in the lateral position and a posterior recess defined by a substantially planar posterior recess support surface disposed adjacent to the lateral support and connected thereto by a first substantially vertical surface, the posterior recess being configured to accommodate the head of the patient when the patient is in the posterior position allowing the head of the patient to be placed in the posterior recess, thus allowing the airway to be straightened and fully open;

a semi-compressible neck support disposed between the chest support and the head support, for supporting the neck of the patient when the neck is extended over the support, allowing the airway to be straightened and opened, said semi-compressible neck support being coupled to said head support;

a semi-compressible posterior bolster disposed continuously along the entire length of the pillow and being configured to support the patient when the patient's superior shoulder is rotated posteriorly against the bolster, the posterior bolster having a second substantially vertical surface that is substantially parallel to the first substantially vertical surface and separated therefrom by the posterior recess support surface; and an arcuately shaped shoulder recess, for the accommodation of the dependent shoulder of the patient while lying in the lateral position on the pillow, the shoulder recess being defined by the chest support and the lateral support;

wherein the posterior recess support surface is substantially parallel to and located adjacent to and in a lower position than the anterior support surface and wherein the semi-compressible neck support includes a substantially planar top surface and first and second ends, the first end terminating into the arcuately shaped shoulder recess and the second end terminating into the second substantially vertical surface of the semi-compressible posterior bolster, the second substantially vertical surface extending vertically upward from the top surface of the semi-compressible neck support and being configured to support the head of the patient when it is in the posterior recess and to support the back of the patient when the patient is rotated posteriorly.

7. The medical support pillow of claim 6, wherein the posterior bolster is coupled to the head support and the chest support.

8. The medial support pillow of claim 6, wherein the posterior bolster extends above the chest support and the neck support.

9. A medical support pillow for supporting a patient on a support surface in the lateral position while maintaining an open and adequate airway, comprising:

a chest support, for providing elevation and support of the chest of the patient above the level of the support surface;

a head support, for supporting the head of the patient, the head support including a lateral support including a substantially planar anterior support surface, for supporting the head of the patient when the patient is in the lateral position, and a posterior recess defined by a substantially planar posterior recess support surface disposed adjacent to the lateral support and connected thereto by a first substantially vertical surface, the posterior recess being configured to accommodate the head of the patient when the patient is in the posterior position allowing the head of the patient to be placed in the posterior recess, thus allowing the airway to be straightened and fully open, the posterior recess support surface being located lower than the anterior support surface;

a neck support disposed between the chest support and the head support, for supporting the neck of the patient when the neck is extended over the neck support, allowing the airway to be straightened and opened;

a posterior bolster continuously disposed along the entire length of the pillow and being configured to support the patient when the patient's superior shoulder is rotated posteriorly against the bolster, the posterior bolster extending above the chest support and the neck support and having a second substantially vertical surface that is substantially parallel to the first substantially vertical surface and separated therefrom by the posterior recess support surface; and an arcuately shaped shoulder recess, for the accommodation of the dependent shoulder of the patient while lying in the lateral position on the pillow, the shoulder recess being defined by the chest support and the lateral support;

wherein the posterior recess support surface is substantially parallel to and located adjacent to the anterior support surface and wherein the neck support includes a substantially planar top surface and first and second ends, the first end terminating into the arcuately shaped shoulder recess and the second end terminating into the second substantially vertical surface of the semi-compressible posterior bolster, the second substantially vertical surface extending vertically upward from the top surface of the neck support and being configured to support the head of the patient when it is in the posterior recess and to support the back of the patient when the patient is rotated posteriorly.

10. The medical support-pillow of claim 9 wherein the shoulder recess is disposed substantially perpendicular to a portion of the posterior bolster to enable the dependent shoulder to occupy the shoulder recess at the same time the superior shoulder is supported by the posterior bolster.

* * * * *

UNITED STATES PATENT AND TRADEMARK OFFICE

CERTIFICATE OF CORRECTION

PATENT NO. : 7,908,691 B2
APPLICATION NO. : 11/636946
DATED : March 22, 2011
INVENTOR(S) : Thomas J. Small It is certified that error appears in the above-identified patent and that said Letters Patent is hereby corrected as shown below:

Column 9, Claim 8, line 18, please replace the term “medial” with the term “medical”

Signed and Sealed this
Seventeenth Day of May, 2011

David J. Kappos

David J. Kappos
*Director of the United States Patent and Trademark Office*